US010593463B2

(12) United States Patent
Peck, Jr.

(10) Patent No.: US 10,593,463 B2
(45) Date of Patent: Mar. 17, 2020

(54) MAGNETIC CORE SIGNAL MODULATION

(71) Applicant: THE BOEING COMPANY, Chicago, IL (US)

(72) Inventor: James Leo Peck, Jr., Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/940,290

(22) Filed: Mar. 29, 2018

(65) Prior Publication Data

US 2018/0218820 A1 Aug. 2, 2018

Related U.S. Application Data

(60) Division of application No. 14/218,470, filed on Mar. 18, 2014, now Pat. No. 9,947,450, which is a (Continued)

(51) Int. Cl.
*H01F 27/28* (2006.01)
*H01F 27/24* (2006.01)
(Continued)

(52) U.S. Cl.
CPC ..... *H01F 27/28* (2013.01); *H01F 17/06* (2013.01); *H01F 27/24* (2013.01); *H01F 27/306* (2013.01);
(Continued)

(58) Field of Classification Search
CPC ..... H01F 27/00–36
(Continued)

(56) References Cited

U.S. PATENT DOCUMENTS 352,105 A 11/1886 Zipernowsky
2,215,521 A 9/1940 Finch
(Continued)

FOREIGN PATENT DOCUMENTS

CN 2528090 Y 12/2002
CN 1444237 A 9/2003
(Continued)

OTHER PUBLICATIONS

Russian Patent Office; Office Action for Russian Patent Application No. 2013130327/07(045241) dated Jul. 18, 2017, 8 Pages.
(Continued)

*Primary Examiner* — Tuyen T Nguyen
(74) *Attorney, Agent, or Firm* — Sage Patent Group

(57) ABSTRACT

A electromagnetic device may include a core in which a magnetic flux is generable and an opening through the core. A primary conductor winding may be received in the opening and extend through the core. A primary electrical current signal flowing through the primary conductor winding generates a magnetic field about the primary conductor winding and a first magnetic flux flow in the core. A secondary conductor winding may be received in the opening and extend through the core. A first modular conductor winding may extend through the opening and encircle a first outer core portion of the core. A first modulation signal flowing through the first modular conductor winding modulates the primary electrical current signal to provide a modulated output current signal at an output of the secondary conductor winding.

20 Claims, 10 Drawing Sheets

Related U.S. Application Data continuation-in-part of application No. 13/553,267, filed on Jul. 19, 2012, now Pat. No. 9,159,487.

(51) Int. Cl.

| | |
|---|---|
| ***H01F 30/06*** | (2006.01) |
| ***H01F 17/06*** | (2006.01) |
| ***H01F 27/30*** | (2006.01) |
| *H01F 38/00* | (2006.01) |
| *H01F 27/245* | (2006.01) |

(52) U.S. Cl.

CPC ..... *H01F 30/06* (2013.01); *H01F 27/245* (2013.01); *H01F 2038/006* (2013.01)

(58) Field of Classification Search

USPC ..... 336/65, 83, 170–175, 180–184, 220–223

See application file for complete search history.

(56) References Cited

U.S. PATENT DOCUMENTS

| | | | | |
|---|---|---|---|---|
| 2,411,374 | A | 11/1946 | Horstman | |
| 2,569,675 | A | 10/1951 | Keefe | |
| 2,780,771 | A | 2/1957 | Bernard | |
| 2,911,586 | A * | 11/1959 | Zelina | G05B 1/025 323/302 |
| 3,042,849 | A | 7/1962 | Dortort | |
| 3,122,699 | A * | 2/1964 | Schohan | G05F 1/32 323/232 |
| 3,253,212 | A * | 5/1966 | Wentworth | G05F 1/32 323/329 |
| 3,411,121 | A | 11/1968 | Twomey | |
| 3,451,130 | A | 6/1969 | Ellis | |
| 3,464,002 | A | 8/1969 | Hentschel | |
| 3,602,859 | A | 8/1971 | Dao | |
| 4,020,440 | A | 4/1977 | Moerman | |
| 4,081,777 | A | 3/1978 | Cronk | |
| 4,338,657 | A | 7/1982 | Lisin et al. | |
| 4,520,335 | A | 5/1985 | Rauch et al. | |
| 4,520,556 | A | 6/1985 | Pasko, Jr. et al. | |
| 4,565,746 | A | 1/1986 | Hayase | |
| 4,577,175 | A | 3/1986 | Burgher et al. | |
| 4,616,205 | A | 10/1986 | Praught et al. | |
| 4,668,931 | A | 5/1987 | Boenitz | |
| 4,684,882 | A | 8/1987 | Blain | |
| 4,876,638 | A * | 10/1989 | Silva | H01F 29/14 363/97 |
| 4,897,626 | A | 1/1990 | Fitter | |
| 4,972,353 | A | 11/1990 | Kennedy et al. | |
| 5,351,017 | A | 9/1994 | Yano et al. | |
| 5,486,756 | A | 1/1996 | Kawakami et al. | |
| 5,534,831 | A | 7/1996 | Yabuki et al. | |
| 5,534,837 | A | 7/1996 | Brandt | |
| 5,557,249 | A | 9/1996 | Reynal | |
| 5,668,707 | A | 9/1997 | Barrett | |
| 5,737,203 | A | 4/1998 | Barrett | |
| 5,999,078 | A | 12/1999 | Herbert | |
| 6,144,282 | A | 11/2000 | Lee | |
| 6,181,079 | B1 | 1/2001 | Chang et al. | |
| 6,715,198 | B2 | 4/2004 | Kawakami | |
| 6,972,657 | B1 | 12/2005 | Pacala et al. | |
| 6,995,646 | B1 | 2/2006 | Fromm et al. | |
| 7,015,691 | B2 | 3/2006 | Kang et al. | |
| 7,023,313 | B2 | 4/2006 | Sutardja | |
| 7,023,317 | B1 | 4/2006 | Herbert | |
| 7,071,807 | B1 | 7/2006 | Herbert | |
| 7,106,047 | B2 | 9/2006 | Taniguchi | |
| 7,148,675 | B2 | 12/2006 | Itoh | |
| 7,242,275 | B2 * | 7/2007 | Poniatowski | H01F 27/38 336/226 |
| 7,280,025 | B2 | 10/2007 | Sane | |
| 7,307,502 | B2 | 12/2007 | Sutardja | |
| 7,342,477 | B2 | 3/2008 | Brandt et al. | |
| 7,362,206 | B1 | 4/2008 | Herbert | |
| 7,378,828 | B2 | 5/2008 | Brandt | |
| 7,407,596 | B2 | 8/2008 | Choi et al. | |
| 7,639,520 | B1 | 12/2009 | Zansky et al. | |
| 8,497,677 | B2 | 7/2013 | Miyahara | |
| 8,582,255 | B2 | 11/2013 | Xin et al. | |
| 8,980,053 | B2 | 3/2015 | Krahn et al. | |
| 9,106,125 | B1 | 8/2015 | Brandt et al. | |
| 9,159,487 | B2 | 10/2015 | Peck | |
| 2001/0052837 | A1 | 12/2001 | Walsh | |
| 2002/0075119 | A1 | 6/2002 | Herbert | |
| 2002/0163330 | A1 | 11/2002 | Sekiya | |
| 2003/0080845 | A1 | 5/2003 | Fontanella et al. | |
| 2003/0117251 | A1 | 6/2003 | Haugs et al. | |
| 2004/0027121 | A1 | 2/2004 | Choi et al. | |
| 2004/0051617 | A1 | 3/2004 | Buswell | |
| 2004/0124958 | A1 | 7/2004 | Watts et al. | |
| 2004/0135661 | A1 | 7/2004 | Haugs et al. | |
| 2005/0035761 | A1 | 2/2005 | Park et al. | |
| 2005/0093669 | A1 | 5/2005 | Ahn et al. | |
| 2006/0082430 | A1 | 4/2006 | Sutardja | |
| 2006/0089022 | A1 | 4/2006 | Sano | |
| 2006/0197480 | A1 | 9/2006 | Mori et al. | |
| 2007/0171019 | A1 | 7/2007 | Sutardja | |
| 2008/0143465 | A1 | 6/2008 | Tan et al. | |
| 2008/0150664 | A1 | 6/2008 | Blankenship et al. | |
| 2008/0163475 | A1 | 7/2008 | Snyder | |
| 2009/0128274 | A1 | 5/2009 | Park et al. | |
| 2009/0244937 | A1 | 10/2009 | Liu | |
| 2009/0289754 | A1 | 11/2009 | Shpiro et al. | |
| 2010/0134044 | A1 | 6/2010 | Sin | |
| 2010/0134058 | A1 | 6/2010 | Nagashima et al. | |
| 2010/0164673 | A1 | 7/2010 | Shim | |
| 2010/0194373 | A1 | 8/2010 | Hamberger et al. | |
| 2011/0095858 | A1 | 4/2011 | Spurny | |
| 2011/0163834 | A1 | 7/2011 | Stahmann et al. | |
| 2011/0210722 | A1 | 9/2011 | Paci et al. | |
| 2011/0279100 | A1 | 11/2011 | Ikriannikov | |
| 2011/0279212 | A1 | 11/2011 | Ikriannikov et al. | |
| 2012/0150679 | A1 | 6/2012 | Lazaris | |
| 2012/0225784 | A1 | 9/2012 | Piascik et al. | |
| 2012/0226386 | A1 | 9/2012 | Kulathu et al. | |
| 2012/0315792 | A1 | 12/2012 | Costello | |
| 2013/0043725 | A1 | 2/2013 | Birkelund | |
| 2013/0049751 | A1 | 2/2013 | Hamberger et al. | |
| 2013/0082814 | A1 | 4/2013 | Markowski et al. | |
| 2013/0255899 | A1 | 10/2013 | Krahn et al. | |
| 2013/0328165 | A1 | 12/2013 | Harburg et al. | |
| 2014/0022040 | A1 | 1/2014 | Peck | |
| 2014/0210585 | A1 | 7/2014 | Peck, Jr. | |
| 2014/0232384 | A1 | 8/2014 | Peck, Jr. | |
| 2014/0347153 | A1 | 11/2014 | Moon | |
| 2015/0043119 | A1 | 2/2015 | Peck, Jr. | |
| 2016/0189847 | A1 | 6/2016 | Willis | |
| 2017/0047155 | A1 | 2/2017 | Yao et al. | |
| 2017/0053728 | A1 | 2/2017 | Mehrotra et al. | |

FOREIGN PATENT DOCUMENTS

| | | | |
|---|---|---|---|
| CN | 1495435 | A | 5/2004 |
| CN | 1514258 | A | 7/2004 |
| CN | 1577647 | A | 2/2005 |
| CN | 1615462 | A | 5/2005 |
| CN | 1637969 | A | 7/2005 |
| CN | 1763872 | A | 4/2006 |
| CN | 101995507 | A | 3/2011 |
| CN | 202839278 | U | 3/2013 |
| DE | 2926423 | A1 | 1/1981 |
| DE | 4129265 | A1 | 3/1993 |
| EP | 1345036 | A2 | 9/2003 |
| EP | 2688076 | A2 | 1/2014 |
| JP | 59119810 | A | 7/1984 |
| JP | 01242333 | A | 9/1989 |
| JP | 02096797 | A | 4/1990 |
| JP | 02192705 | A | 7/1990 |
| JP | 06260869 | A | 9/1994 |
| JP | 07037729 | A * | 2/1995 |
| JP | 09077452 | A | 3/1997 |
| JP | 2001167933 | A | 6/2001 |
| JP | 2005116666 | A | 4/2005 |

(56) References Cited

FOREIGN PATENT DOCUMENTS

| | | | |
|---|---|---|---|
| JP | 2010127889 | A | 6/2010 |
| JP | 2011238653 | A | 11/2011 |
| JP | 2013149909 | A | 8/2013 |
| RU | 2007146701 | A | 6/2009 |
| WO | 02095775 | A1 | 11/2002 |
| WO | 2007078403 | A2 | 7/2007 |
| WO | 2009075110 | A1 | 6/2009 |
| WO | 2014130122 | A1 | 8/2014 |

OTHER PUBLICATIONS

Chinese Patent Office; Office Action for Chinese Patent Application No. 201310299638.5 dated Jul. 14, 2017, 33 Pages.
U.S. Appl. No. 14/218,470, filed Mar. 18, 2104, Pending.
U.S. Appl. No. 13/553,267, filed Jul. 19, 2012, U.S. Pat. No. 9,159,487, Oct. 13, 2015.
Fedder, Gary K., et al.; "Laminated High-Aspect-Ratio Microstructures in a Conventional CMOS Process," 3roceedings of the IEEE Micro Electro Mechanical Systems Workshop, 1996, pp. 13-18.
Chee, Clinton Y.K., et al.; "A Review on the Modelling of Piezoelectric Sensors and Actuators Incorporated in Intelligent Structures," Journal of Intelligent Material Systems and Structures, 1998, pp. 3-19, vol. 9.
Wilson, Earl J.; "Strain-Gage Instrumentation," Harris' Shock and Vibration Handbook, 2002, pp. 17.1-17.15, Chapter 17, 5th Edition.
Simoes Moita, Jose M., et al.; "Active control of adaptive laminated structures with bonded piezoelectric sensors and actuators," Computers and Structures, 2004, pp. 1349-1358, vol. 82.
European Patent Office; International Search Report and Written Opinion for International Application No. PCT/US2013/072789 dated May 27, 2014, 12 Pages.
International Bureau of WIPO; International Preliminary Report on Patentability for International Application No. PCT/US2013/072789 dated Aug. 25, 2015, 9 Pages.
Japanese Patent Office; Office Action for Japanese Patent Application No. 2013-149909 dated Jun. 6, 2017, 6 Pages.
European Patent Office, European Patent Application No. 14178702.8, European Search Report dated Jan. 21, 2015, 7 pages.
9EUROPEAN Patent Office; Extended European Search Report for European Patent Application No. 13173067.3 dated Nov. 3, 2015, 9 Pages.
European Patent Office; Extended European Search Report for European Patent Application No. 14179801.7 dated Jul. 10, 2015, 14 Pages.
Chinese Patent Office; Office Action for Chinese Application No. 201310299638.5 dated May 27, 2016, 37 Pages.
Chinese Patent Office; Office Action for Chinese Patent Application No. 2013800736555 dated Aug. 26, 2016, 16 Pages.
Chinese Patent Office; Office Action for Chinese Patent Application No. 201310299638.5 dated Dec. 18, 2017, 37 Pages.
European Patent Office; Extended European Search Report for European Patent Application No. 16195663.6 dated May 26, 2017, 9 Pages.
European Patent Office; Extended European Search Report for European Patent Application No. 16205134.6 dated May 29, 2017, 9 Pages.

* cited by examiner

MAGNETIC CORE SIGNAL MODULATION

CROSS-REFERENCE TO RELATED APPLICATIONS

This application is a divisional of U.S. patent application Ser. No. 14/218,470, filed Mar. 18, 2014, now U.S. Pat. No. 9,947,450, which is a continuation-in-part of U.S. patent application Ser. No. 13/553,267, filed Jul. 19, 2012, entitled "Linear Transformer," now U.S. Pat. No. 9,159,487 which is assigned to the same assignee as the present application and is incorporated herein in its entirety by reference.

FIELD

The present disclosure relates to electromagnetic devices, such as electrical transformers and inductors, and more particularly to an electromagnetic device, such as a transformer or similar device including magnetic core signal modulation.

BACKGROUND

Electromagnetic devices, such as inductors, transformers and similar devices include magnetic cores in which a magnetic flux flow may be generated in response to an electrical current flowing through a conductor winding associated with the magnetic core. As current (AC) in the magnetic core increases, the inductance in the core increases (energy storage in the device increases). In a transformer configuration which includes a primary winding connected to an electrical power source and a secondary winding connected to a load, changes in the current or voltage supplied by the electrical power source can significantly change the energy being stored in the magnetic core for transfer into the secondary. FIG. 1 is an example of an electromagnetic device 100 which may be an inductor or transformer. The electromagnetic device 100 includes a plurality of electrical conductors, wires or windings 102 wrapped or wound around a ferromagnetic core 104. The core 104 is an electromagnetic material and is magnetized in response to an electrical current flowing in the windings 102. A magnetic flux illustrated by broken lines 106 and 108 is also generated by the electromagnetic device 100 in response to the electrical current flowing through the windings 102. As illustrated in FIG. 1, the magnetic flux 106 and 108 will flow in a path through the core 102 and in the free space about the electromagnetic device 100. Accordingly, the magnetic flux 106 and 108 flowing in free space about the electromagnetic device 100 does not produce any useful energy coupling or transfer and is inefficient. Because of this inefficiency, such prior art electromagnetic devices, inductors, transformers and the like, generally require larger, heavier electromagnetic cores and additional windings to provide a desired energy conversion or transfer. Additionally, core may be formed by stacking a plurality of plates that define a substantially square or rectangular shaped box. The flux throughout the core will be uniform because of the uniform shape of the core. In a transformer configuration with a primary winding and a secondary winding, an output signal at the secondary winding will be directly proportional to an input signal applied to the primary winding based on the turns ratio of the primary and secondary windings.

SUMMARY

In accordance with an embodiment, an electromagnetic device may include a core in which a magnetic flux is generable and an opening through the core. A primary conductor winding may be received in the opening and extend through the core. A primary electrical current signal flowing through the primary conductor winding generates a magnetic field about the primary conductor winding and a first magnetic flux flow in the core. A secondary conductor winding may be received in the opening and extend through the core. A first modular conductor winding may extend through the opening and encircle a first outer core portion of the core. A first modulation signal flowing through the first modular conductor winding modulates the primary electrical current signal to provide a modulated output current signal at an output of the secondary conductor winding.

In accordance with another embodiment, an electromagnetic device may include a core in which a magnetic flux is generable. The electromagnetic device may also include a first elongated opening through the core and a second elongated opening through the core. The electromagnetic device may also include a primary conductor winding extending in one direction through the core through the first elongated opening, and the primary conductor winding extending in an opposite direction through the core through the second elongated opening. A primary electrical current signal flowing through the primary conductor winding generates a magnetic field about the primary conductor winding. The magnetic field generates a first primary magnetic flux flow in one direction around the first elongated opening and a second primary magnetic flux flow in an opposite direction around the second elongated opening. The electromagnetic device may also include a secondary conductor winding extending in one direction through the core through the first elongated opening and the secondary conductor winding also extends in an opposite direction through the core through the second elongated opening. The electromagnetic device may additionally include a first modular conductor winding through the first elongated opening and encircling a first outer core portion of the core adjacent the first elongated opening. A first modulation signal flowing through the first modular conductor winding modulates the primary electrical current signal to provide a modulated output current signal at an output of the secondary conductor winding.

In accordance with further embodiment, a method for modulating a current in an electromagnetic device may include providing a core in which a magnetic flux is generable. The method may also include providing an opening through the core and extending a primary conductor winding through the opening and the core. Passing a primary electrical current signal through the primary conductor winding generates a magnetic field about the primary conductor winding and generates a first magnetic flux flow in the core. The method may additionally include extending a secondary conductor winding through the opening and the core and extending a modular conductor winding through the opening and encircling an outer core portion. The method may further include adjusting a modulation signal flowing through the modular conductor winding to modulate the primary electrical current signal to provide a modulated output current signal at the secondary conductor winding.

BRIEF DESCRIPTION OF THE SEVERAL VIEWS OF DRAWINGS

The following detailed description of embodiments refers to the accompanying drawings, which illustrate specific embodiments of the disclosure. Other embodiments having different structures and operations do not depart from the scope of the present disclosure.

DESCRIPTION

Figure 1:
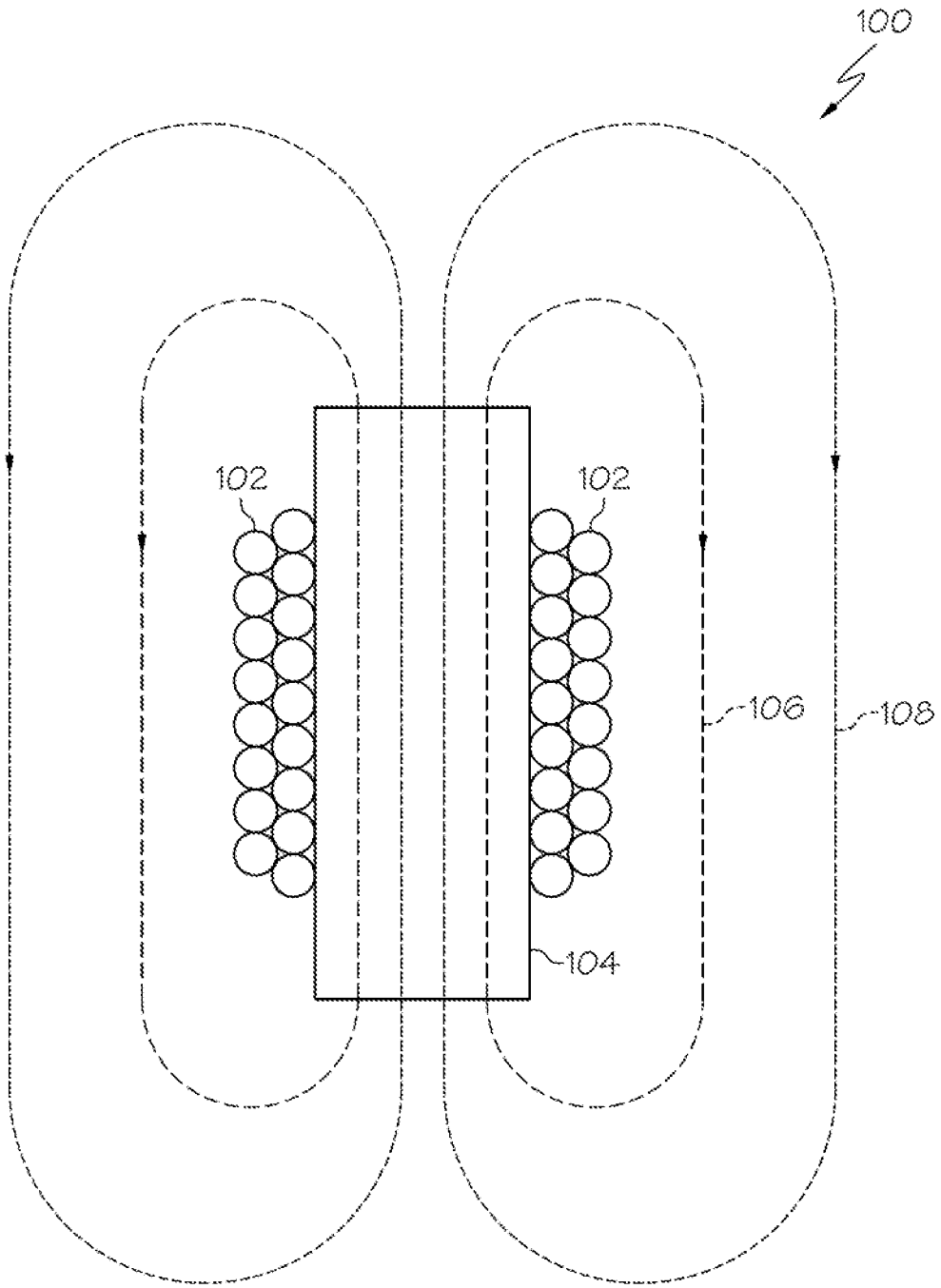
FIG. 1 (PRIOR ART)
FIG. 1 is an example of a prior art transformer.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

In accordance with an embodiment of the present disclosure, a linear inductor is an electromagnetic device having only one electrical conductor wire winding or windings passing through a magnetic core. In accordance with another embodiment, a linear transformer is an electromagnetic device where a linear primary electrical conductor wire winding or windings and one or more linear secondary electrical conductor wire winding or windings pass through a magnetic core. The core may be one piece and no turns of the primary and secondary electrical conductors about the core are required. While the core may be one piece, the one piece core may be formed from a plurality of stacked plates or laminates. A current may be conducted through the primary. A magnetic flux from the current in the primary is absorbed by the core. When the current in the primary decreases the core transmits an electromotive force (desorbs) into the secondary wires. A feature of the linear transformer is the linear pass of the primary and secondary conductors through the core. One core may be used as a standalone device or a series of two or more cores may be used where a longer linear exposure is required. Another feature of this transformer is that the entire magnetic field or at least a substantial portion of the magnetic field generated by the current in the primary is absorbed by the core, and desorbed into the secondary. The core of the transformer may be sized or include dimensions so that substantially the entire magnetic field generated by the current is absorbed by the core and so that the magnetic flux is substantially completely contained with the core. This forms a highly efficient transformer with very low copper losses, high efficiency energy transfer, low thermal emission and very low radiated emissions. Additionally the linear transformer is a minimum of about 50% lower in volume and weight then existing configurations. Linear electromagnetic devices, such as linear transformers, inductors and similar devices are described in more detail in U.S. patent application Ser. No. 13/553,267, filed Jul. 19, 2012, entitled "Linear Electromagnetic Device" which is incorporated herein in its entirety by reference. A magnetic core flux sensor assembly is described in more detail in U.S. patent application Ser. No. 13/773,135, filed Feb. 21, 2013, entitled "Magnetic Core Flux Sensor and is incorporated herein in its entirety by reference.

Figure 2A:
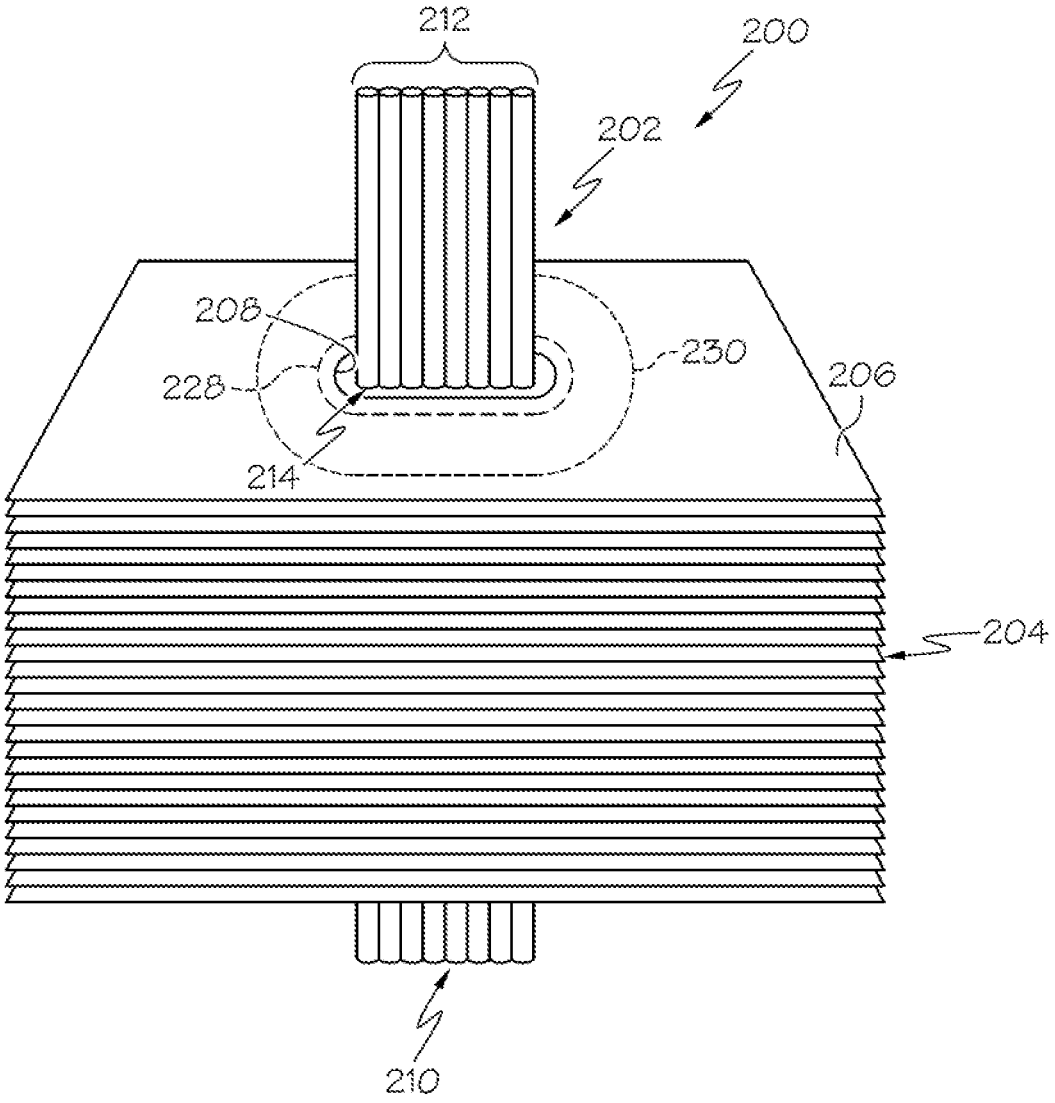
FIG. 2A is a perspective view of an example of an electromagnetic device in accordance with an embodiment of the present disclosure.

FIG. 2A is a perspective view of an example of an electromagnetic device 200 in accordance with an embodiment of the present disclosure. The electromagnetic device 200 illustrated in FIG. 2A is configured as a linear inductor 202. The linear inductor 202 may include a core 204. The core 204 may include a plurality of plates 206 or laminations stacked on one another. The plates 206 may be made from a silicon steel alloy, a nickel-iron alloy or other metallic material capable of generating a magnetic flux similar to that described herein. For example, the core 204 may be a nickel-iron alloy including about 20% by weight iron and about 80% by weight nickel. The plates 206 may be substantially square or rectangular, or may have some other geometric shape depending on the application of the electromagnetic device and the environment where the electromagnetic device 200 may be located. For example, the substantially square or rectangular plates 206 may be defined as any type of polygon to fit a certain application or may have rounded corners so that the plates 206 are not exactly square or rectangular.

An opening is formed through each of the plates 206 and the openings are aligned to form an opening 208 or passage through the core 204 when the plates 206 are stacked on one another with the plate openings 206 in alignment with one another. The opening 208 or passage may be formed in substantially a center or central portion of the core 204 and extend substantially perpendicular to a plane defined by each plate 206 of the stack of plates 206 or laminates. In another embodiment, the opening 208 may be formed off center from a central portion of the core 204 in the planes defined by each of the plates 206 for purposes of providing a particular magnetic flux or to satisfy certain constraints.

An electrical conductor 210 or wire may be received in the opening 208 and may extend through the core 204 perpendicular the plane of each of the plates 206. The electrical conductor 210 may be a primary conductor. In the exemplary embodiment illustrated in FIG. 2A, the electrical conductor 210 is a plurality of electrical conductors 212 or wires. In another embodiment, the electrical conductor 210 may be a single conductor.

Figure 2B:
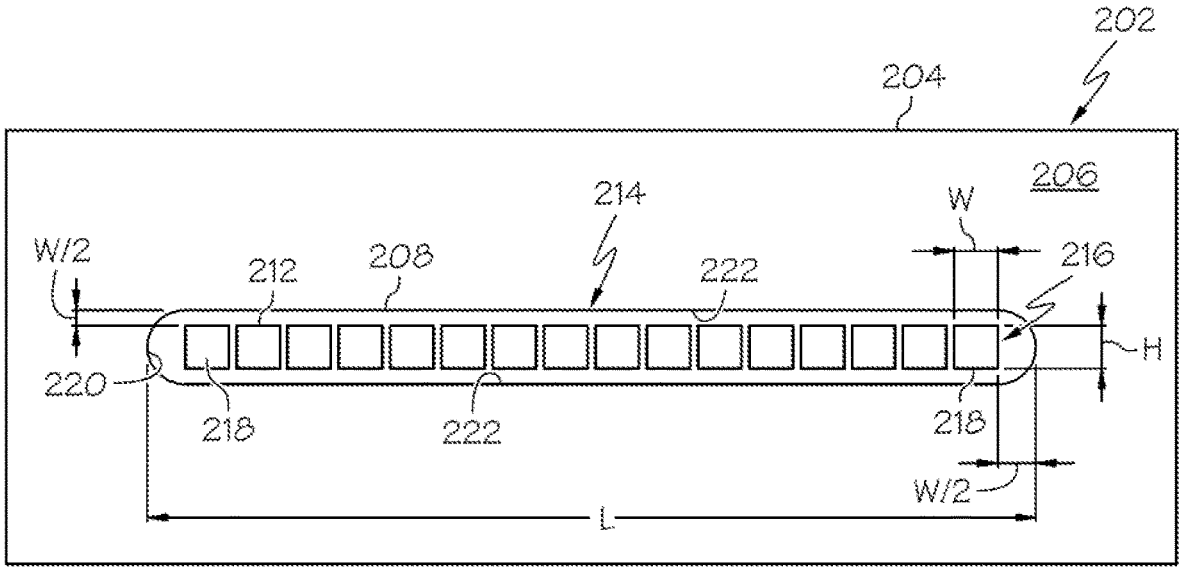
FIG. 2B is a top view of the electromagnetic device of FIG. 2A.

Referring also to FIG. 2B, FIG. 2B is a top view of the linear inductor 202 of FIG. 2A. The opening 208 through the core 204 may be an elongated slot 214. As previously discussed, the opening 208 or elongated slot 214 may be formed through a center or central portion of the core 204 when looking into the plane of the top plate 206. The opening 208 or elongated slot 214 may be an equal distance from opposite sides of the core 204, or as illustrated in FIG.

2B, the elongated slot 214 may be off set and may be closer to one side of the core 204. For some applications, the opening 208 may also be formed in a shape other than an elongated slot 214 depending upon the application and desired path of the magnetic flux generated in the core.

As previously discussed, the electrical conductor 210 may be a plurality of primary conductors 212 that are aligned adjacent one another or disposed in a single row 216 within the elongated slot 214. Each of the conductors 212 may include a substantially square or rectangular cross-section as illustrated in FIG. 2B. The substantially square or rectangular cross-section may be defined as being exactly square or rectangular or may have rounded edges or other features depending upon the application and desired coupling or transfer of magnetic flux into the core 204 when an electrical current flows through the conductors 212. The conductor 210 may also be a single elongated ribbon conductor extending within the elongated slot 214 and having a cross-section corresponding to the elongated slot 214 or other opening shape.

The cross-section of each primary conductor 212 may have a predetermined width "W" in a direction corresponding to an elongated dimension or length "L" of the elongated slot 214. An end primary conductor 218 at each end of the single row 216 of conductors is less than about one half of the predetermined width "W" from an end 220 of the elongated slot 214. Each conductor 212 also has a predetermined height "H." Each conductor 212 is less than about one half of the predetermined height "H" from a side wall 222 of the elongated slot 214.

Figure 2C:
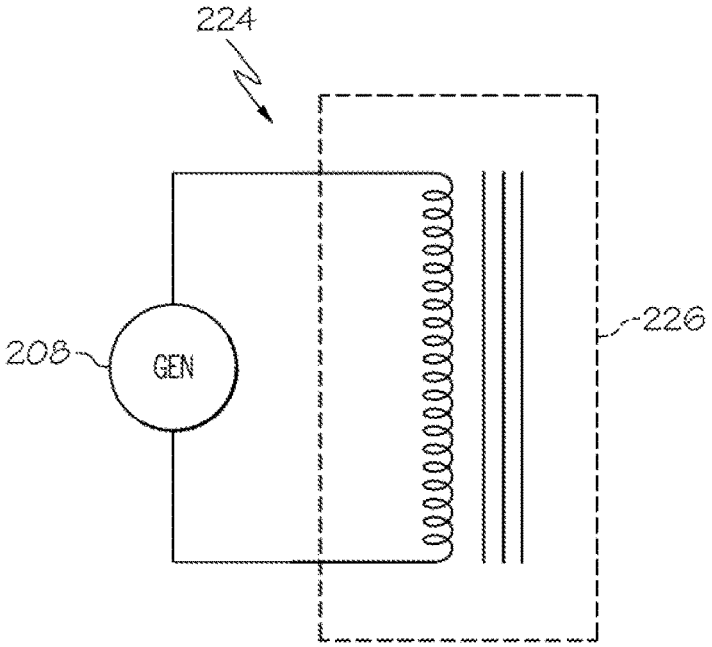
FIG. 2C is a block diagram an example of an electrical circuit including the linear inductor of FIG. 2A in accordance with an embodiment of the present disclosure.

FIG. 2C is a block diagram an example of an electrical circuit 224 including a linear inductor 226 in accordance with an embodiment of the present disclosure. The linear inductor 226 may be the same as the linear inductor 202 in FIGS. 2A and 2B. A generator 208 may be connected to the linear inductor 226 to conduct an electrical current through the linear inductor 226. A magnetic field is generated about the electrical conductor 210 (FIGS. 2A and 2B) or each of the plurality of electrical conductors 212 in response to the electrical current flowing in the conductor or conductors. The core 204 may be sized so that substantially the entire magnetic field is absorbed by the core 204 to generate a magnetic flux in the core 204 as illustrated by broken lines 228 and 230 in FIG. 2A and the core may be sized so that the magnetic flux is substantially completely contained within the core. In an embodiment, the core 204 may be sized relative to the conductor or conductors 212 and electrical current flowing in the conductor or conductors 212 to absorb at least about 96% of the magnetic field to generate the magnetic flux in the core 204. The magnetic flux may also be at least about 96% contained within the core 24. Any magnetic flux generated outside the core 204 may be infinitesimally small compared to the magnetic flux contained within the core.

Figure 3A:
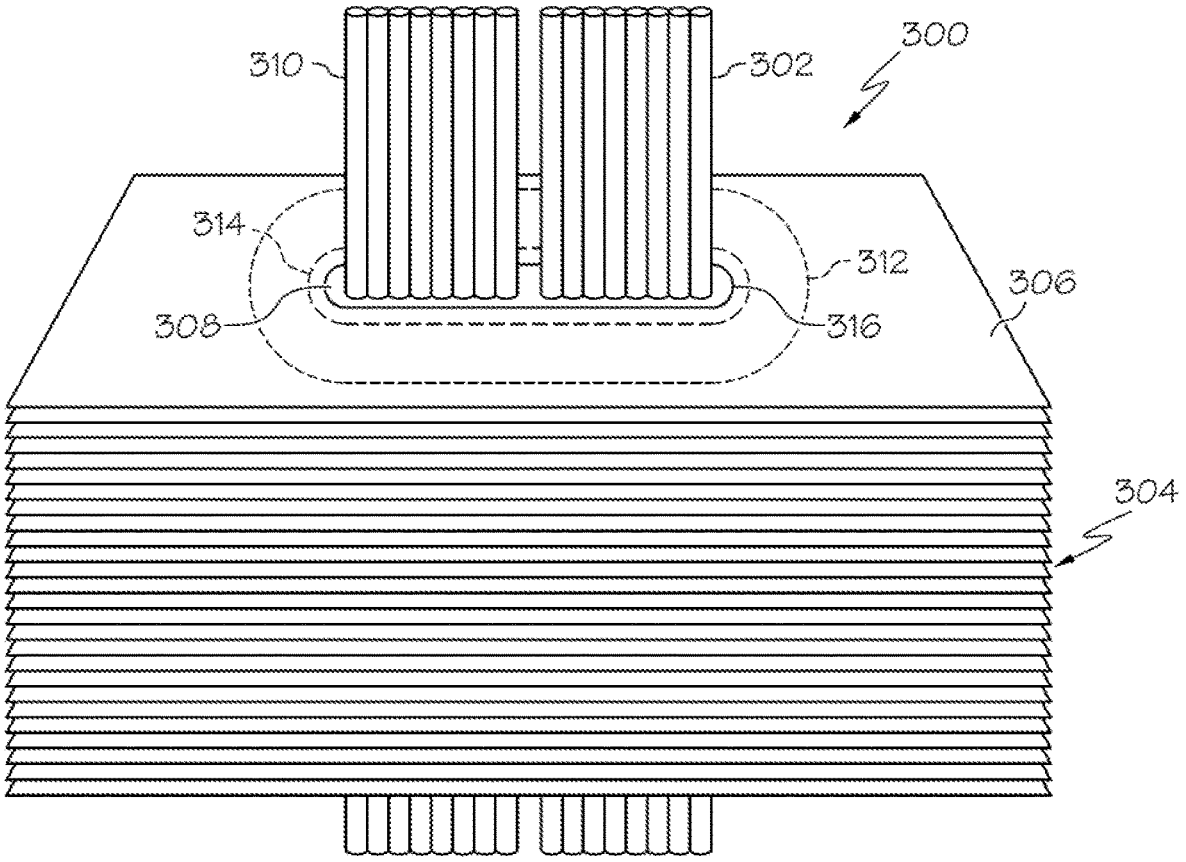
FIG. 3A is a perspective view of an example of an electromagnetic device configured as a linear transformer in accordance with an embodiment of the present disclosure.

FIG. 3A is a perspective view of an example of an electromagnetic device in the configuration of a linear transformer 300 in accordance with an embodiment of the present disclosure. The linear transformer 300 is similar to the linear inductor 202 of FIG. 2A but includes a secondary conductor 302 or plurality of secondary conductors. Accordingly, the linear transformer 300 includes a core 304 in which a magnetic flux may be generated. Similar to that previously described, the core 304 may include a plurality of plates or laminations 306 that may be stacked upon one another as illustrated and FIG. 3A. Each of the plates 306 may have an opening formed therein to provide an opening 308 or passage through the core 304. The opening 308 or passage through the core 304 may be substantially perpendicular to a plane defined by each of the plates 306. The secondary conductor or conductors 302 extend within the opening 308 through the core 304. The primary conductor or plurality of primary conductors 310 may extend adjacent to the secondary conductors 302 within the opening 308 through the core 304.

Similar to that previously described, each of the primary conductors 310 may have a substantially square or rectangular cross-section. An electrical current flowing through the primary conductor or conductors generates a magnetic field about the primary conductor. The core 304 may be sized or to include length and width dimensions of the plates 306 to absorb substantially the entire magnetic field to generate the magnetic flux as illustrated by broken lines 312 and 314 in FIG. 3A. The core 304 may also be sized or include length and width dimensions so that the magnetic flux is substantially entirely contained within the core 304. In an embodiment, the core 304 may be sized or may include width and length dimensions of the plates 306 to absorb at least about 96% of the magnetic field and/or to contain at least about 96% of the magnetic flux.

Each of the secondary conductors 302 extending through the core 304 may also have a substantially square or rectangular cross-section to receive an electro-motive force transmitted by the core 304.

The opening 308 through the core 304 may be an elongated slot 316 similar to the elongated slot 214 in FIGS. 2A and 2B. The plurality of primary conductors 310 and plurality of secondary conductors 302 may each be disposed adjacent one another in a single row in the elongated slot 316.

A cross-section of each primary conductor 310 of the plurality of conductors and each secondary conductor 302 of the plurality of conductors may have a predetermined width "W" in a direction corresponding to a length of the elongated slot 316 similar to that illustrated in FIG. 2B. An end primary conductor adjacent one end of the elongated slot 316 is less than about one half of the predetermined width "W" from the one end of the elongated slot 316. An end secondary conductor adjacent an opposite end of the elongated slot 316 is less than about one half of the predetermined width "W" from the opposite end of the elongated slot.

The cross-section of each primary conductor 310 and secondary conductor 302 may have a predetermined height "H." Each primary conductor 310 and second conductor 302 is less than about one half of the predetermined height "H" from a side wall of the elongated slot 316.

Figure 3B:
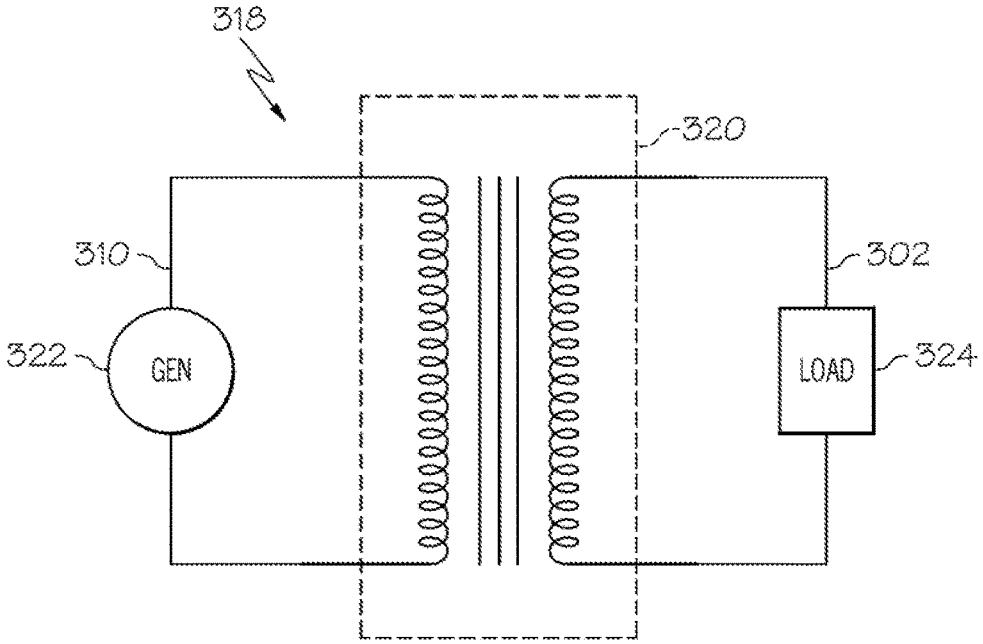
FIG. 3B is a block diagram an example of an electrical circuit including the linear transformer of FIG. 3A in accordance with an embodiment of the present disclosure.

FIG. 3B is a block diagram an example of an electrical circuit 318 including a linear transformer 320 in accordance with an embodiment of the present disclosure. The linear transformer 320 may be the same as the linear transformer 300 in FIG. 3A. A generator 322 may be connected to the primary conductors 310 and a load 324 may be connected to the secondary conductors 302. Voltage and current supplied by the generator 322 to the linear transformer 320 is converted or transformed based on the number and characteristics of primary conductors or windings and the number and characteristics of secondary conductors or windings and the core 304.

Figure 4A:
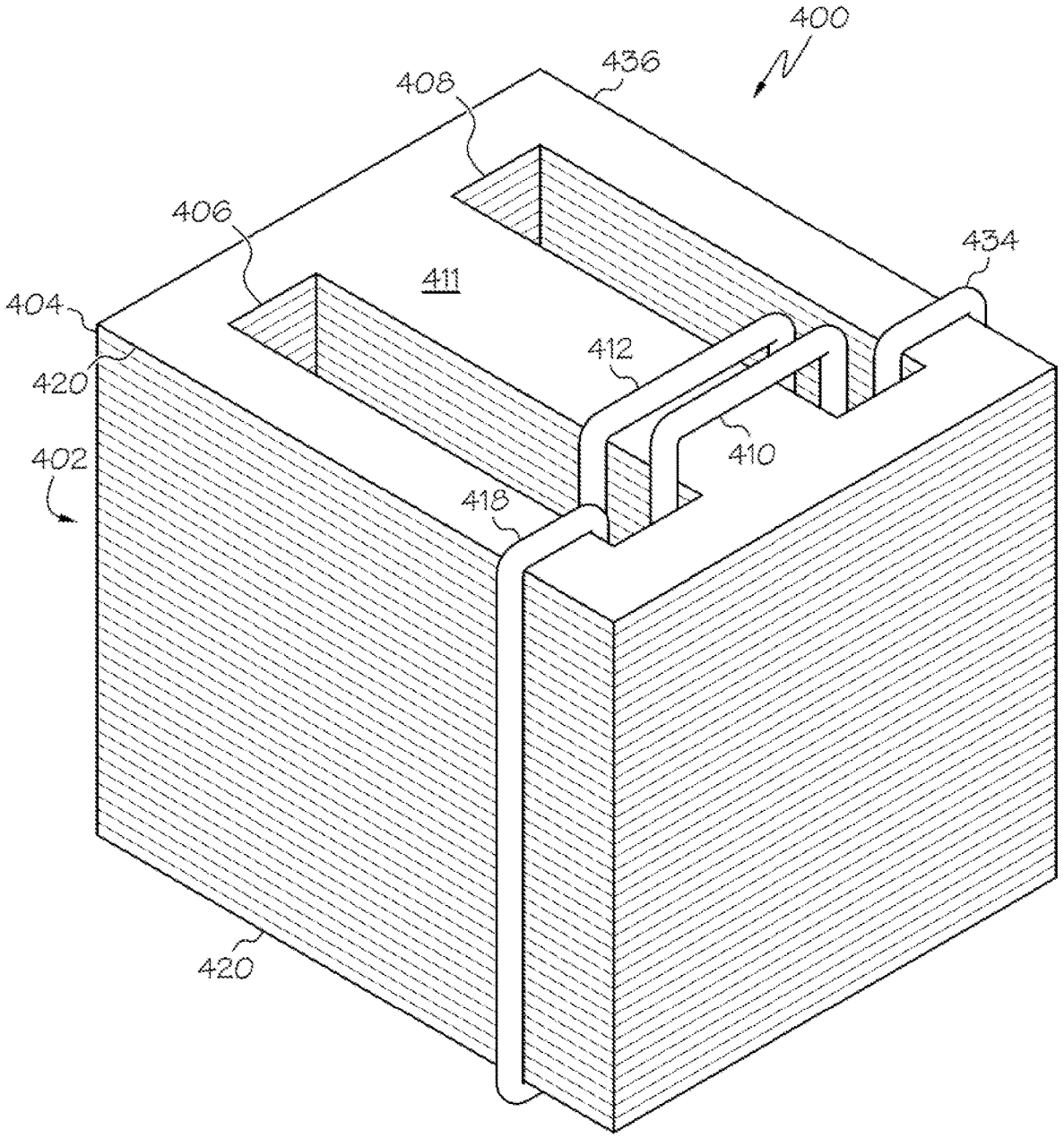
FIG. 4A is a perspective view of an example of an electromagnetic device in accordance with another embodiment of the present disclosure.
Figure 4B:
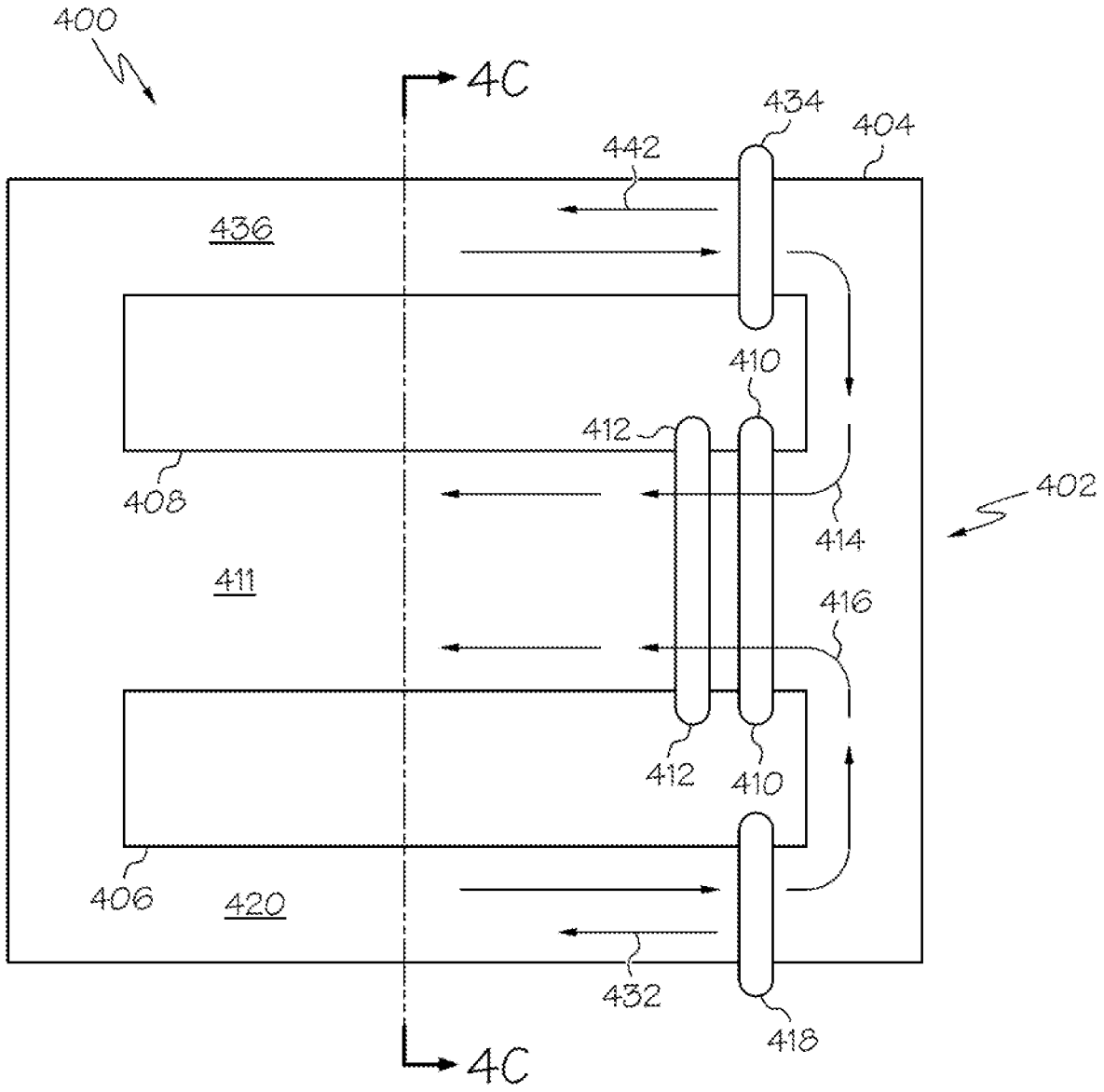
FIG. 4B is a top elevation view of the exemplary electromagnetic device of FIG. 4A.

FIG. 4A is a perspective view of an example of an electromagnetic device 400 in accordance with another embodiment of the present disclosure. The electromagnetic device 400 may be similar to the electromagnetic device 200 in FIG. 2A or the electromagnetic device 300 in FIG. 3A. The electromagnetic device 400 may include a magnetic flux core 402. The magnetic flux core 402 may be formed by a plurality of plates 404 or laminates stacked or layered on one another as illustrated in FIG. 4A. Referring also to FIG. 4B, FIG. 4B is a top elevation view of the exemplary electromagnetic device 400 of FIG. 4A. In FIG. 4B only the top plate 404 or laminate of the stack of plates forming the magnetic flux core 402 or simply core is visible in FIG. 4B. Each of the plates 404 or laminates may be substantially square or rectangular shaped. The plates 404 being substantially square or rectangular shaped may be defined as the plates 404 not being exactly square or rectangular shaped. For example, the plates 404 may have rounded edges, the sides may not be perfectly square, the sides may have different lengths, opposite sides may not be exactly parallel or some other differences.

Each of the plates 404 may include a first elongated opening 406 or slot and a second elongated opening 408 or slot. The first elongated opening 406 and the second elongated opening 408 may be parallel to one other or may be at some angle with respect to each other. The first elongated opening 406 and the second elongated opening 408 in each of the plates 404 are aligned with one another when the plates 404 are stacked on one another to form the core 402. Accordingly, the first elongated opening 406 and the second elongated opening 408 will be provided or formed through the core 402 when the plates 404 are stacked on one another to form the core 402.

Figure 4C:
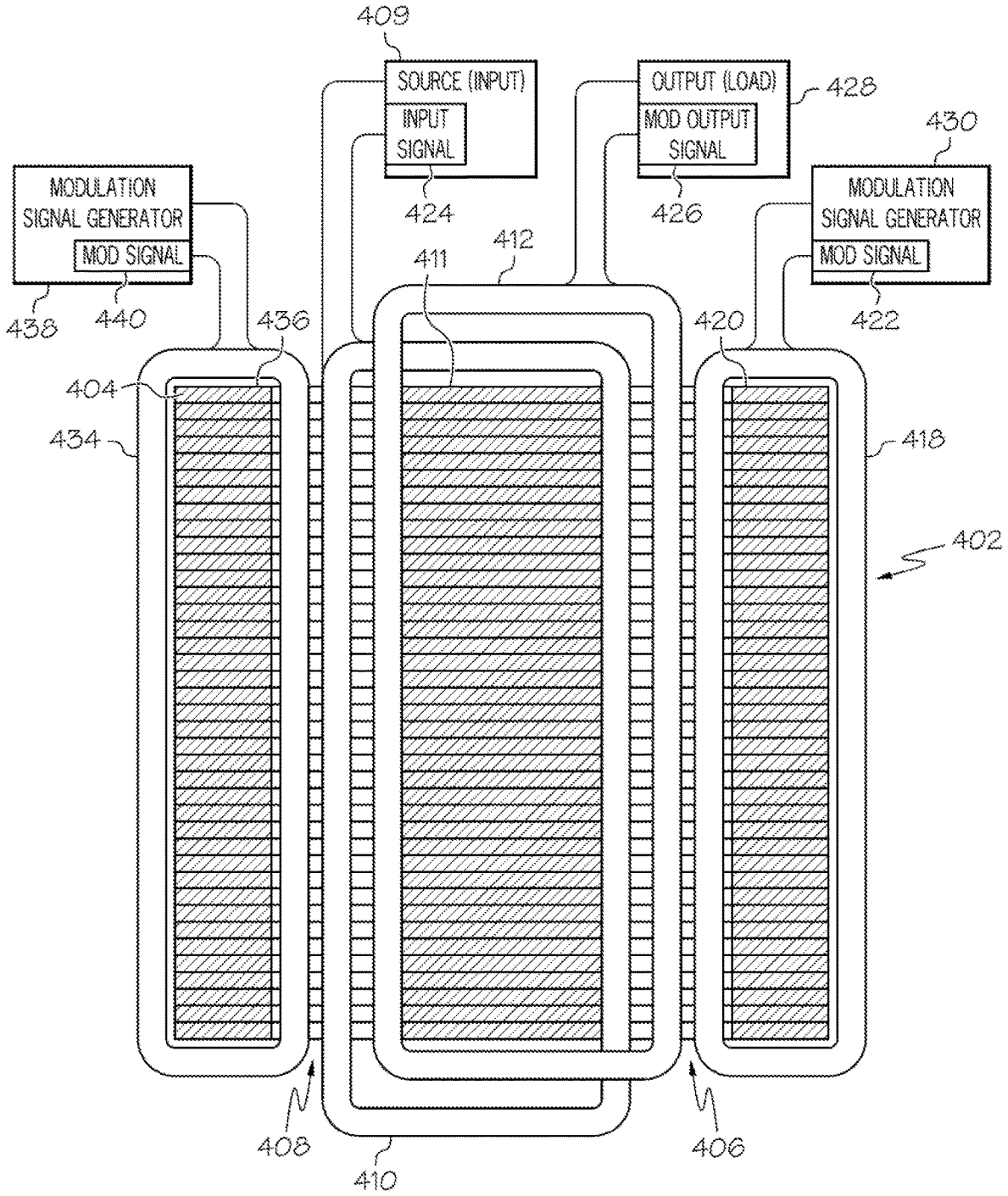
FIG. 4C is a cross-sectional view of the exemplary electromagnetic device of FIG. 4B taken along lines 4C-4C.

Referring also to FIG. 4C, FIG. 4C is a cross-sectional view of the exemplary electromagnetic device 400 of FIGS. 4A and 4B taken along lines 4C-4C in FIG. 4B. A primary conductor winding 410 may be received in the first elongated opening 406 and the second elongated opening 408. Only a single conductor or wire wrap is illustrated in FIGS. 4A-4C to represent the primary conductor winding 410 for purposes of clarity. The primary conductor winding 410 may include a single wire wrapped or wound multiple times through the elongated openings 406 and 408 and around a central portion 411 of the core 402. Accordingly, the primary conductor winding 410 including multiple wire wraps may be considered to extend in one direction through the core 402 through the first elongated opening 406 and the primary conductor winding may be considered to extend in an opposite direction through the core 602 through the second elongated opening 408. The primary conductor winding 410 may be coupled to an electrical power source 409 or input for generating an electrical input signal 424.

In a transformer configuration, the electromagnetic device 400 may include a primary conductor winding 410 and a secondary conductor winding 412. Only a single conductor or wire wrap is illustrated in FIGS. 4A-4C for purposes of clarity. The secondary conductor winding 412 may also include a single wire wrapped or wound multiple times through the first and second elongated openings 406 and 408. Thus, the secondary conductor winding 412 may be considered as extending in one direction through the core 402 through the first elongated opening 406 and in an opposite direction through the core 402 through the second elongated opening 408. In one embodiment, the primary conductor winding 410 and the secondary conductor winding 412 may be wound side-by-side or adjacent one another in the first elongated opening 406 and second elongated opening 408 similar to that illustrated in the example of FIG. 3A. In other embodiment, the primary conductor winding 410 and the secondary conductor winding 412 may be wound according to any particular arrangement based on particular desired operating characteristics.

An electrical current flowing through the primary conductor winding 410 generates a magnetic field around the primary conductor winding 410 and a magnetic flux flow is created in the magnetic core 402 as illustrated by arrows 412 and 414 in FIG. 4B. The magnetic flux flow in the magnetic core 402 will be in opposite directions about the respective elongated openings 406 and 408, as illustrated by arrows 414 and 416, because of the direction of electric current flow in the primary conductor winding 410 through the elongated openings 406 and 408 and the right-hand rule. Based on the right-hand rule, electric current flowing into the page on FIG. 4B in primary conductor winding 410 through elongated opening 408 will cause a magnetic flux flow in the direction of arrow 414 in the example in FIG. 4B, and electric current flowing out of the page in the same winding 410 through elongated opening 406 will cause a magnetic flux flow in the direction of arrow 416. If the current flows in the opposite direction in the primary winding 410, the direction of the magnetic flux flow will be opposite to that shown by arrows 414 and 416 in the example of FIG. 4B. The magnetic flux flow around the first elongated opening 406 may be referred to herein as the first primary magnetic flux flow (arrow 416 in FIG. 4B) and the magnetic flux flow around the second elongated opening may be referred to herein a the second primary magnetic flux flow (arrow 414 in FIG. 4B).

The electromagnetic device 400 may also include at least one modular conductor winding or a first modular conductor winding 418 through the first elongated opening 406 and encircling a first outer core portion 420 of the core 402 adjacent the first core opening 406 as best shown in FIG. 4C. Only a single conductor or wire wrap is illustrated in FIGS. 4A-4C to represent the first modular conductor winding 418 for purposes of clarity. The modular conductor winding 418 may include a single wire wrapped or wound multiple times through the elongated opening 406 and around the first outer core portion 420 of the core 402. A first modulation signal 422 flowing through the first modulation conductor winding 418 may modulate a primary electrical current signal 424 flowing in the primary conductor winding 410 to provide a modulated output current signal 426 at an output 428 of the secondary conductor winding 412. The first modulation signal 422 may be generated by a first modulation signal generator 430. The first modulation signal 422 flowing through the first modular conductor 418 generates a second magnetic flux flow in the core 402 as illustrated by arrow 432 in FIG. 4B. The magnitude and direction of the second magnetic flux flow 432 will be dependent upon the amplitude and direction of flow of the current of first modulation signal 422 in the first modular conductor winding 418. In the example illustrated in FIG. 4B, the amplitude and direction of flow of the current of the first modulation signal 422 results in the second magnetic flux flow 432 in a direction opposite to the first primary magnetic flux flow 416. Therefore, the second magnetic flux flow 432 attenuates or reduces the first primary magnetic flux flow 416 which may also be referred to as attenuating the core 402. The primary input signal 424 modulated by the first modulation signal 422 that generated the second magnetic flux flow 432 (FIG. 4B) will result in a modulated output signal 426 that is reduced or attenuated compared to the primary input signal 424. The modulated output signal 426 or amplitude of the modulated output signal 426 will be reduced or attenuated by an amount corresponding to the attenuation of the first primary magnetic flux flow 416 by the second magnetic flux flow 432. An example of the modulation signal causing attenuation of the primary input signal will be described with reference to FIG. 5.

Alternatively, the first modulation signal 422 being conducted through the first modular winding 418 in the opposite direction may produce a second magnetic flux flow in an opposite direction to arrow 432 in FIG. 4B. Accordingly, the second magnetic flux flow in the same direction as the first primary magnetic flux flow 416 will increase the total magnetic flux flow in the core 402 and may saturate the core 402 or partially saturate the core 402. As the core 402 approaches saturation or absorbing the maximum capacity of magnetic flux the core 402 is configured or sized to handle, the ability of the magnetic flux in the core 402 to transfer energy from the primary conductor winding 410 to the secondary conductor winding 412 is reduced.

The modulation signal 422 or signals in the modular winding 418 or windings may be adjusted as described herein to modulate the input signal and power passing from the primary conductor winding 410 to the secondary conductor winding 412. Accordingly, the first modulation signal 422 flowing through the first modular conductor winding 418 may be adjusted or controlled to generate the second magnetic flux flow 432 in the core 402. The second magnetic flux flow 432 may include a predetermined magnitude and direction of flow in the core 402 in response to adjusting the first modulation signal 422. As previously discussed, the first modulation signal 422 flowing in the first modular conductor winding 418 is adjustable for generating the second magnetic flux flow 432 in the core 402 to either increase the first primary magnetic flux flow 416 or attenuate the first primary magnetic flux flow 416 around the first elongated opening 406. The first modulation signal generator 430 may be configured to adjust the first modulation signal 422.

The electromagnetic device 400 may include a second modular conductor winding 434 through the second elongated opening 408 and encircling a second outer core portion 436 of the core 402 adjacent the second elongated opening 408. Only a single conductor or wire wrap is illustrated in FIGS. 4A-4C to represent the second modular conductor winding 434 for purposes of clarity. The modular conductor winding 434 may include a single wire wrapped or wound multiple times through the elongated opening 408 and around the second outer core portion 436 of the core 402. A second modulation signal generator 438 may generate a second modulation signal 440 flowing through the second modular conductor winding 434. The second modulation signal 440 flowing through the second modular conductor winding 434 may generate a third flux flow in the core 402 illustrated by arrow 442 in FIG. 4B. Similar to the first modulation signal 422, the second modulation signal 440 may be adjusted to generate the third magnetic flux flow 442 in the core 402. The third magnetic flux flow 442 may include a predetermined magnitude and direction of flow in the core 402 in response to adjusting the second modulation signal 440. As shown in the example of FIG. 4B, the current of second modulation signal 440 is adjusted or is flowing in the second modular winding 434 in a direction to cause the third magnetic flux flow 442 (FIG. 4B) in an opposite direction to the second primary flux flow 414 around the second elongated opening 408. Accordingly, the third magnetic flux flow 442 will attenuate the second primary flux flow 414. Alternatively, the second modulation signal 440 may be adjusted or controlled to cause current flow in an opposite direction in the second modular winding 434 to generate the third magnetic flux flow in an opposite directions to that shown by arrow 442 in FIG. 4B. In this arrangement, the third magnetic flux flow will be in the same directions as the second primary flux flow 414 around the second elongated opening 408. The third magnetic flux flow may then add to the second primary flux flow 414 and may drive the electromagnetic device to saturation or partial saturation reducing the signal or energy transfer from the primary conductor winding 410 to the secondary conductor winding 412. The second modulation signal generator 438 may be configured to adjust the second modulation signal 440.

The first modulation signal 422 and the second modulation signal 440, when either one or both modulation signals are flowing through their respective modular conductor windings 418 and 434 may be adjusted or controlled (amplitude and direction of current flow in the modular windings) with respect to one another to provide the modulated output current signal 426 at the output of the secondary conductor winding 428.

Figure 5:
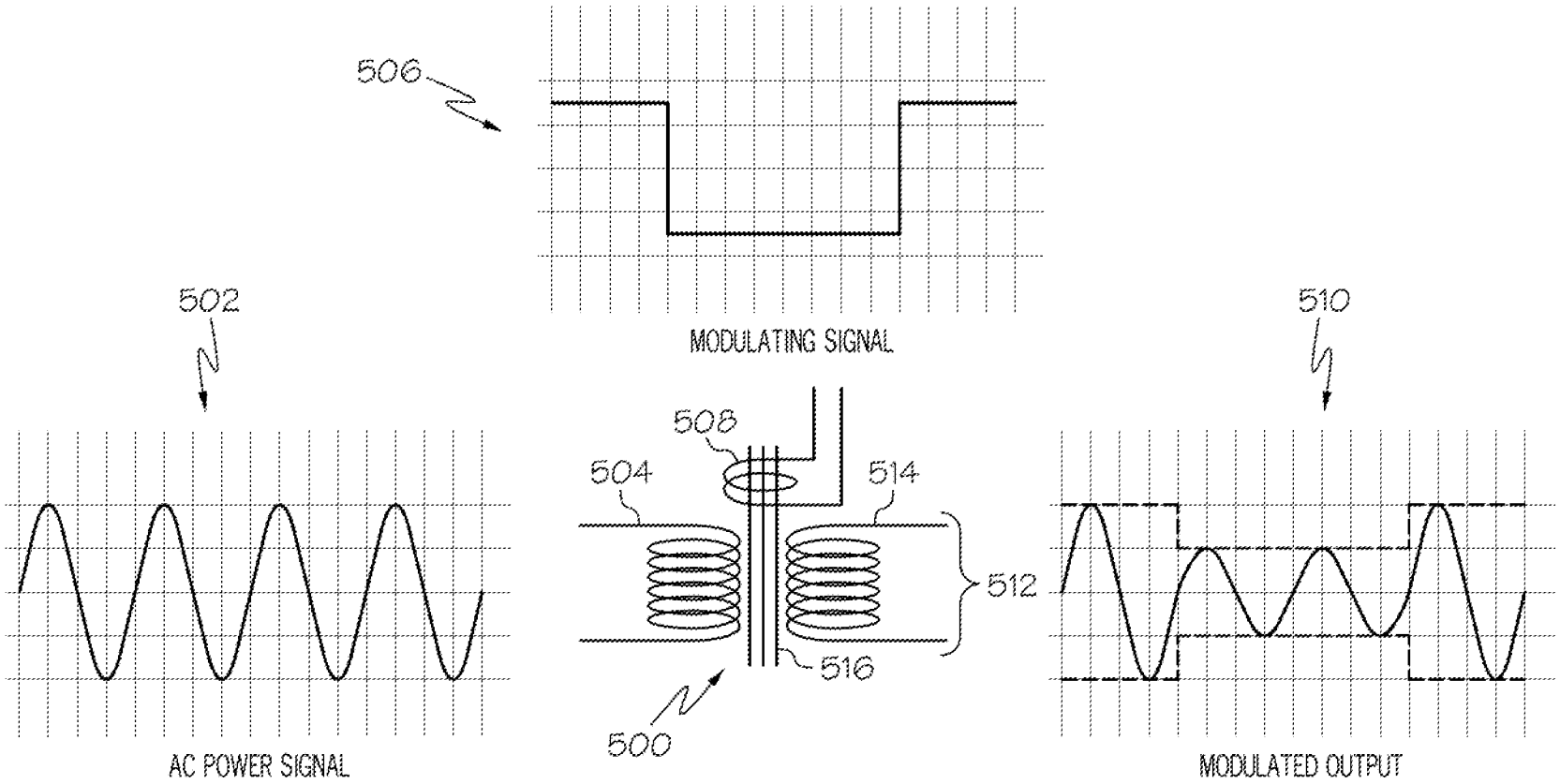
FIG. 5 is a block diagram an example of an electrical circuit including the electromagnetic device of FIGS. 4A-4C in accordance with an embodiment of the present disclosure.

Referring also to FIG. 5, FIG. 5 is a block diagram an example of an electrical circuit 500 representative of the electromagnetic device 400 of FIGS. 4A-4C in accordance with an embodiment of the present disclosure. An alternating current (AC) power signal 502 applied to a primary conductor winding 504 (corresponding to primary winding 410 in FIG. 4C) may be modulated by a modulating signal 506 (422, 440 or both in FIG. 4C) flowing through the modular conductor winding 508 (corresponding to modular conductor winding 418, modular conductor winding 434 or both in FIG. 4C). Modulating the input signal 502 by the modulating signal 506 results in a modulated output signal 510 at an output 512 of the secondary conductor winding 514 (corresponding to secondary conductor winding 412 in FIG. 4C). In the example illustrated in FIG. 5, the modulating signal 506 is a negative direct current (DC) current or pulse. The negative DC current causes a magnetic flux flow in an opposite direction to the primary magnetic flux flow in the core 516 (402 in FIGS. 4A-4C). Accordingly, the AC input power signal 502 is attenuated by the modulating signal 506 to produce the modulated output signal 510 with a reduced amplitude over the duration of the negative modulating DC current signal 506. Alternatively, a positive or more positive going modulating signal may create an increased magnetic flux flow and a modulated output signal with a higher amplitude over the duration of the positive modulating signal compared to the input signal 502. However, the increased magnetic flux flow in the core 516 may saturate or partially saturate the core 516 which can lower the ability of the magnetic flux in the core 516 to transfer energy from the primary winding 504 to the secondary winding 514.

Figure 6:
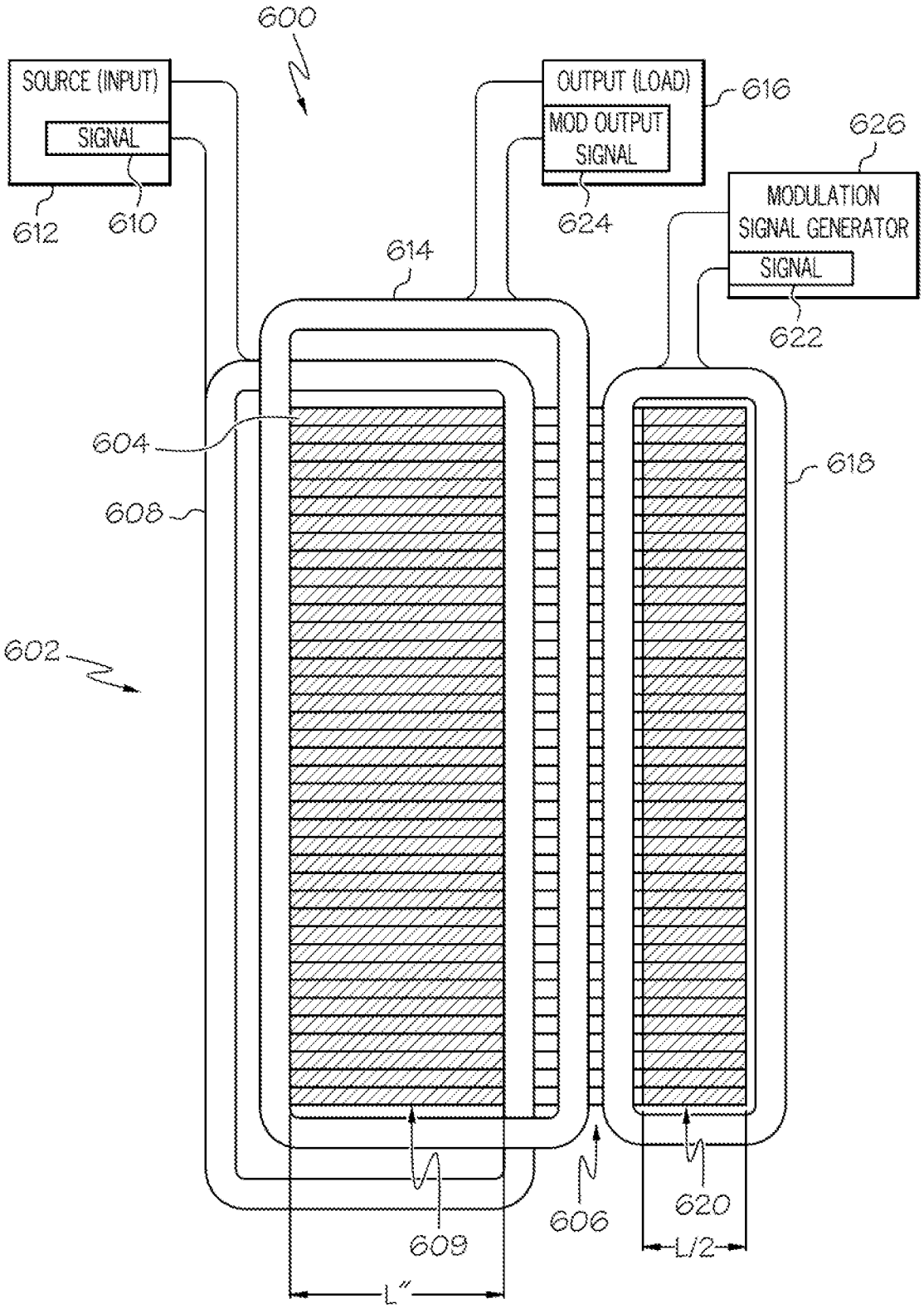
FIG. 6 is a cross-sectional view of the exemplary electromagnetic device in accordance with another embodiment of the disclosure.

FIG. 6 is a cross-sectional view of an exemplary electromagnetic device 600 in accordance with another embodiment of the present disclosure. The electromagnetic device 600 may be similar to the electromagnetic device 400 in FIGS. 4A-4C except with only a single opening through a core. The electromagnetic device 600 may include a core 602 in which a magnetic flux is generable. The core 602 may be formed by stacking a plurality of plates 604 or laminates on one another. The plates 604 may include a substantially square or rectangular shaped surface similar to the plates 404 of the electromagnetic device 400 previously described. Each of the plates 604 may have an opening formed therein such that when the plates 404 are stacked on one another to form the core 602, the openings are aligned to form the opening 606 through the core 602.

A primary conductor winding 608 is received in the opening 606 and extends through the core 602 and is wound around a main portion 609 of the core 602. A primary electrical current signal 610 flowing through the primary conductor winding 608 generates a magnetic field about the primary conductor winding 608 and a first magnetic flux flow in the core 602. The first magnetic flux flow may be similar to either the magnetic flux flow 414 or 416 described with reference to FIG. 4B. The primary electrical current signal 610 may be generated by a source 612 connected to the primary conductor winding 608.

A secondary conductor winding 614 may be received in the opening 606 and may be wound around the main portion 609 of the core 602. The secondary conductor winding 614 may be coupled to an output 616 or load.

A modular conductor winding 618 may extend through the opening 606 and encircles an outer core portion 620 of the core 602. The outer portion 620 of the core 602 may be smaller than the main portion 609. For example, the outer core portion 620 may have a length "L/2" about half the length "L" of the main portion 609. A modulation signal 622 flowing through the first modular conductor winding 618 modulates the primary electrical current signal 610 to provide a modulated output current signal 624 at the output 616 of the secondary conductor winding. The first modulation signal 622 may be generated by a modulation signal generator 626.

The modulation signal generator 626 may be configured to adjust an amplitude and direction of flow of the current of the modulation signal 622 in the modular conductor winding 618. Accordingly, the modulation signal 622 may be adjusted to generate a second magnetic flux flow in the core 602. The second magnetic flux flow may include a predetermined magnitude and direction of flow in the core 602 in response to adjusting the modulation signal 622. The modulation signal 622 may be adjusted for generating the second magnetic flux flow in the core 602 to either increase the first magnetic flux flow or attenuate the first magnetic flux flow similar to that previously described herein.

Figure 7:
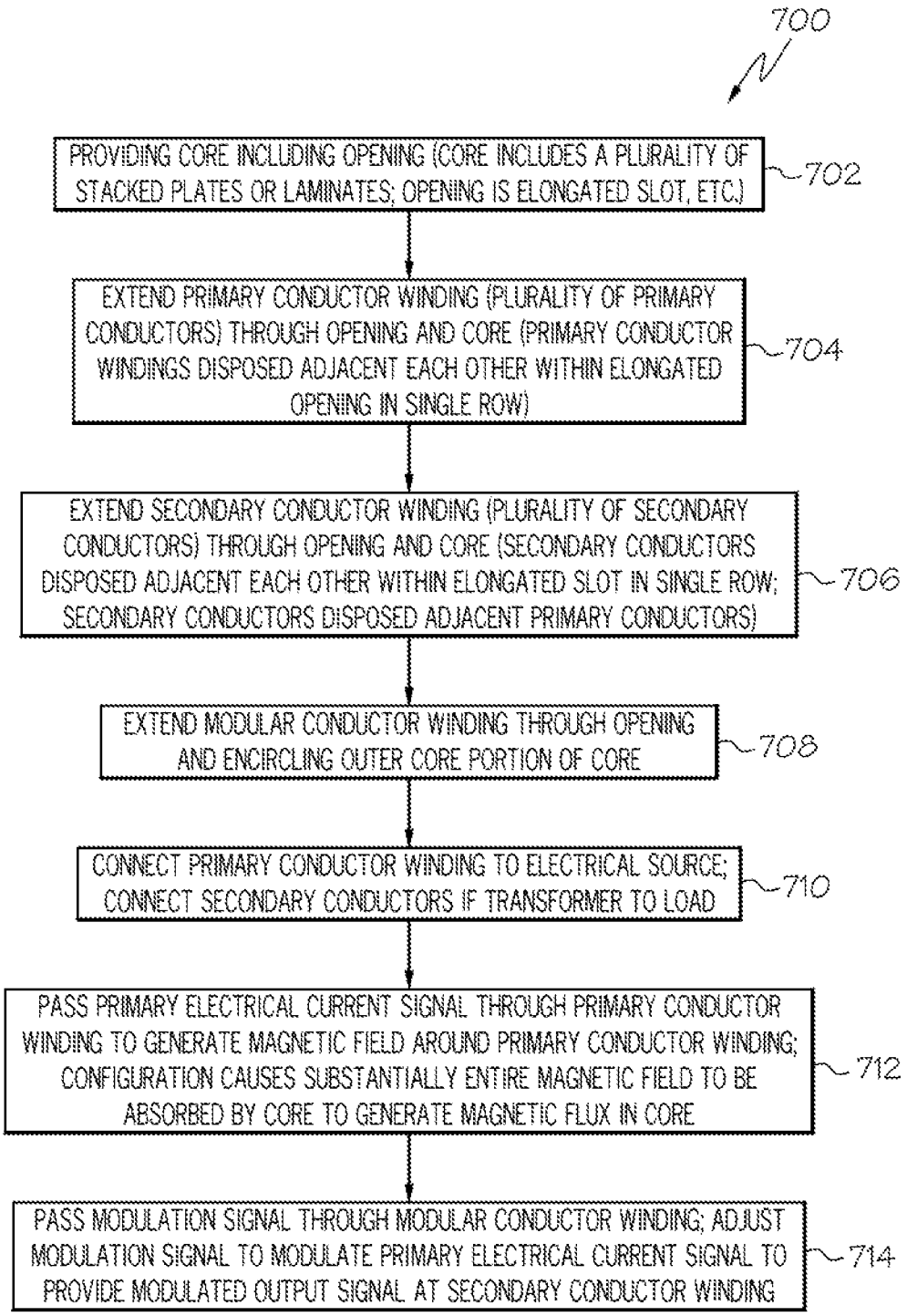
FIG. 7 is a flow chart of an example of a method for modulating a current in an electromagnetic device in accordance with an embodiment of the present disclosure.

FIG. 7 is a flow chart of an example of a method 700 for modulating a current in an electromagnetic device in accordance with an embodiment of the present disclosure. In block 702, a core including an opening through the core may be provided. The core may include a plurality of stacked plates or laminates. A hole may be formed in each of the plates such that the holes in the plates are aligned with one another when the plates are stacked to form the core with the opening. The opening may be an elongated slot similar to that described herein.

In block 704, a primary conductor winding may extend through the opening and the core. The primary conductor winding may include a plurality conductors wound through the opening and may be disposed adjacent one another within the elongated opening in a single row. In block 706, a secondary conductor winding may extend through the opening and the core. The secondary conductor winding may include a plurality of conductors wound through the opening and disposed adjacent each other within the elongated slot and a single row. The primary conductor winding and the secondary conductor winding may be wound around a main portion of the core.

In block 708, a modular conductor winding may extend through the opening and encircle and outer portion of the core.

In block 710, an electrical source may be connected to the primary conductor winding and a load or output may be connected to the secondary conductor winding. In block 712, a primary electrical current signal may be passed through the primary conductor winding to generate a magnetic field around the primary conductor winding. The magnetic field generates a magnetic flux flow in the core. The core may be configured such that substantially the entire magnetic field may be absorbed by the core to generate magnetic flux in the core.

In block 714, a modulation signal may be passed through a modular conductor winding. The modulation signal may be adjusted to modulate the primary electrical current signal to provide a modulated output signal at the secondary conductor winding. The modulation signal generates a second magnetic flux flow in the core. The second magnetic flux flow may include a predetermined magnitude and direction of flow in the core in response to the modulation signal. The modulation signal may be adjusted to generate the predetermined magnitude and direction of flow of the second magnetic flux flow in the core. The modulation signal may be adjusted to cause the second magnetic flux flow in the core to either flow in the same direction as the first magnetic flux flow and contribute to the first magnetic flux flow by an amount corresponding to a magnitude of the second magnetic flux flow, or the second magnetic flux flow may flow in an opposite direction to the first magnetic flux flow and attenuate the first magnetic flux flow by an amount corresponding to a magnitude of the second magnetic flux flow. The modulation signal may be adjusted to cause the second magnetic flux flow to either saturate or attenuate the core.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. An electromagnetic device, comprising:

a core in which a magnetic flux is generable, the core comprising a main core portion, a first outer core portion and a second outer core portion, wherein the main core portion, the second outer core portion and the second outer core portion comprise a same material throughout;

a first opening through the core, wherein the main core portion and first outer core portion are defined by the first opening through the core;

a second opening through the core, wherein the main core portion and second outer core portion are defined by the second opening through the core;

a primary conductor winding extending in one direction through the core through the first elongated opening and the primary conductor winding extending in an opposite direction through the core through the second elongated opening, wherein a primary electrical current signal flowing through the primary conductor winding generates a magnetic field about the primary conductor winding, the magnetic field generating a first primary magnetic flux flow in one direction around the first elongated opening and a second primary magnetic flux flow in an opposite direction around the second elongated opening;

a secondary conductor winding extending in one direction through the core through the first elongated opening and the secondary conductor winding extending in an opposite direction through the core through the second elongated opening;

a first modular conductor winding through the first elongated opening and encircling a first outer core portion of the core adjacent the first elongated opening;

a first modulation signal generator connected to only the first modular conductor winding to generate a first modulation signal through the first modular conductor winding;

a second modular conductor winding, separate from the first modular conductor winding, through the second elongated opening and encircling the second outer core portion of the core adjacent the second elongated opening; and a second modulation signal generator connected to only the second modular conductor winding to generate a second modulation signal through the second modular conductor winding, wherein the first modulation signal and the second modulation signal are adjustable with respect to one another to provide a modulated output current signal at an output of the secondary conductor winding.

2. The electromagnetic device of claim 1, wherein the first modulation signal flowing through the first modular conductor winding is adjustable to generate a second magnetic flux flow in the core, the second magnetic flux flow comprising a predetermined magnitude and direction of flow in the core in response to adjusting the first modulation signal.

3. The electromagnetic device of claim 2, wherein the first modulation signal flowing in the first modular conductor winding is adjustable for generating the second magnetic flux flow in the core to one of increase the first primary magnetic flux flow and attenuate the first primary magnetic flux flow around the first elongated opening.

4. The electromagnetic device of claim 3, wherein the first modulation conductor signal generator is configured to adjust the first modulation signal.

5. The electromagnetic device of claim 2, wherein the second modulation signal flowing through the second modular conductor winding is adjustable to generate a third magnetic flux flow in the core, the third magnetic flux flow comprising a predetermined magnitude and direction of flow in the core in response to adjusting the second modulation signal.

6. The electromagnetic device of claim 5, wherein the second modulation signal flowing in the second modular conductor winding is adjustable for generating the third magnetic flux flow in the core to one of increase the second primary magnetic flux flow and attenuate the second primary magnetic flux flow around the second elongated opening.

7. The electromagnetic device of claim 6, wherein the second modulation conductor signal generator is configured to adjust the second modulation signal.

8. A method for modulating a current in an electromagnetic device, comprising:

providing a core in which a magnetic flux is generable, wherein the core comprises a main core portion, a first outer core portion and a second core portion;

providing a first opening through the core, wherein the main core portion and the first outer core portion are defined by the first opening through the core;

providing a second opening through the core, wherein the main core portion and the second outer core portion are defined by the second opening through the core;

extending a primary conductor winding through the first opening and the second opening and encircling the main core portion;

passing a primary electrical current signal through the primary conductor winding that generates a magnetic field about the primary conductor winding and generates a first magnetic flux flow in the core;

extending a secondary conductor winding through the first opening and the second opening and encircling the main core portion;

extending a first modular conductor winding through the first opening and encircling the first outer core portion;

generating a first modulation signal through the first modular conductor winding by a first modulation signal generator connected to only the first modular conductor winding;

extending a second modular conductor winding, separate from the first modular conductor winding, through the second opening and encircling the second outer core portion;

generating a second modulation signal through the second modular conductor winding by a second modulation signal generator connected to only the second modular conductor winding; and adjusting the first modulation signal and the second modulation signal with respect to one another to provide a modulated output current signal at the secondary conductor winding.

9. The method of claim 8, wherein adjusting the first modulation signal through the first modular conductor winding comprises generating a second magnetic flux flow in the core, the second magnetic flux flow comprising a predetermined magnitude and direction of flow in the core in response to adjusting the first modulation signal.

10. The method of claim 8, wherein adjusting the first modulation signal through the first modular conductor winding comprises generating a second magnetic flux flow in the core to one of increase the first magnetic flux flow and attenuate the first magnetic flux flow.

11. The method of claim 8, wherein adjusting the first modulation signal through the first modular conductor winding comprises generating a second magnetic flux flow in the core to one of saturate the core and attenuate the core.

12. The electromagnetic device of claim 1, wherein the first opening and the second opening through the core each comprise an elongated slot.

13. The electromagnetic device of claim 1, wherein the primary conductor winding comprises a first plurality of wraps of the primary conductor through the opening in the core and the secondary conductor winding comprises a second plurality of wraps of the secondary conductor through the opening in the core.

14. The electromagnetic device of claim 1, wherein the first modular conductor winding comprises a third plurality of wraps of the first modular conductor through the first opening and encircling the first outer core portion of the core.

15. The electromagnetic device of claim 1, wherein the second modular conductor winding comprises a fourth plurality of wraps of the second modular conductor through the second opening and encircling the second outer core portion of the core.

16. The electromagnetic device of claim 1, wherein the core comprises a plurality of plates or laminates that are stacked or layered on one another.

17. The electromagnetic device of claim 16, wherein each of the plates or laminates is substantially square or rectangular shaped.

18. The electromagnetic device of claim 1, wherein the main core portion comprises a larger cross-sectional dimension than the first outer core portion and the second outer core portion.

19. The electromagnetic device of claim 1, wherein the primary conductor winding in wound around the main core portion.

20. The method of claim 9, wherein the adjusting the second modulation signal through the second modular conductor winding comprises generating a third magnetic flux flow in the core, the third magnetic flux flow comprising a predetermined magnitude and direction of flow in the core in response to adjusting the second modulation signal.

* * * * *